US007500429B2

(12) United States Patent
Willamor

(10) Patent No.: US 7,500,429 B2
(45) Date of Patent: Mar. 10, 2009

(54) SPLIT MARINE TRASH COMPACTOR SYSTEM

(76) Inventor: Martin A. Willamor, 6450 Lake Victoria Dr., Theodore, AL (US) 36582

( * ) Notice: Subject to any disclaimer, the term of this patent is extended or adjusted under 35 U.S.C. 154(b) by 0 days.

(21) Appl. No.: 11/529,079

(22) Filed: Sep. 28, 2006

(65) Prior Publication Data

US 2008/0098909 A1 May 1, 2008

(51) Int. Cl.
*B30B 15/18* (2006.01)

(52) U.S. Cl. ..... 100/35; 100/51; 100/226; 100/229 A; 100/269.01; 100/269.14

(58) Field of Classification Search ..... 100/35, 100/50, 51, 52, 100, 225, 226, 229 A, 269.01, 100/269.14
See application file for complete search history.

(56) References Cited

U.S. PATENT DOCUMENTS 3,403,935 A * 10/1968 Spradling ..... 296/164
3,734,006 A * 5/1973 Hennells ..... 100/349
3,802,335 A * 4/1974 Longo ..... 100/35
4,483,248 A * 11/1984 Ostreng ..... 100/99
4,620,479 A 11/1986 Diamond et al.
4,700,623 A * 10/1987 Durbin et al. ..... 100/52
4,729,303 A * 3/1988 Durbin ..... 100/214
5,465,660 A 11/1995 Conti et al.
5,490,455 A 2/1996 Conti et al.
6,035,776 A 3/2000 Segura
6,640,701 B2 11/2003 Hoffjann et al.
6,701,832 B1 3/2004 Hawkins

* cited by examiner

*Primary Examiner*—Jimmy T Nguyen
(74) *Attorney, Agent, or Firm*—McNair Law Firm, P.A.; Henry S. Jaudon

(57) ABSTRACT

A split-trash compacting system for a vessel having a plurality of compartments comprising a trash compacting assembly disposed in a first compartment of the vessel readily accessible to persons on the vessel for receiving and compacting trash. At least one fluid actuator unit is provided for forcing the compacting head downward into a trash bin for compacting trash during a compaction cycle and retracting the compacting head during a retraction cycle. A fluid actuating assembly is disposed in a second compartment of the vessel remote from the trash compacting assembly for supplying pressurized fluid to the trash compacting assembly for actuating the fluid actuator unit. At least one fluid line connecting the fluid actuator in the first compartment and the fluid actuating assembly in the second compartment.

14 Claims, 3 Drawing Sheets

SPLIT MARINE TRASH COMPACTOR SYSTEM

FIELD OF THE INVENTION

This invention relates to a marine trash compactor and, more particularly, to a split fluid trash compactor system having a large capacity yet requires a minimum of space on a vessel.

BACKGROUND OF THE INVENTION

With offshore boating and sports fishing becoming more and more popular, the problem of daily living on such vessels has presented a problem with trash disposal. It is not unusual for pleasure boats, and commercial and sports fishing boats, to remain offshore for several days without trash removal. Typically trash is packed in plastic bags and thrown in the engine compartment. However, large amounts of trash are produced on such boats making trash storage in the engine compartment unsafe and inconvenient when trying to work in the engine compartment. Kitchen trash compactors are not suitable onboard such boats because of inadequate capacity and the requirement of electrical power which is sometimes not only inconvenient, but unsafe in boat applications. In particular, sparks from electrical switching needed on the conventional trash compactor are dangerous in a boat environment. Domestic trash compactors are typically gear driven and noisy.

Hydraulic trash compactors are known which do not require conventional electrical power, but these units are typically too large and too cumbersome for vessel use. For example, U.S. Pat. No. 6,701,832 discloses a trash compactor for high traffic public areas having hydraulic means to compact trash. U.S. Pat. No. 6,640,701 discloses a trash compactor for use on a passenger transportation vehicle having a liquid drain for draining compressed liquids from containers during the process. U.S. Pat. No. 6,035,776 discloses a refuse and grinding system for use on a vessel or offshore platform using a hydraulic or compressed air compactor. U.S. Pat. Nos. 5,465,660 and 5,490,455 disclose aircraft trash compactors using electrical power. U.S. Pat. No. 4,620,479 discloses a hydraulic, aircraft trash compactor enclosed in a housing wherein hydraulic pump is enclosed in the housing also.

Generally, the prior art has not provided a trash compactor assembly having adequate capacity and safety, yet may be used in a relatively small space on board a boat or vessel.

Accordingly, an object of the present invention is to provide a trash compactor for a transport vehicle, such as a pleasure boat, sport fishing boat, or commercial fishing boat, and the like, which may be located in the galley or other location on board the boat conveniently accessible by passengers in a minimum space and which is safe and effective in handling the large amounts of trash produced on such vessels.

Another object of the present invention is to provide a hydraulic trash compactor for a pleasure, sports fishing, and/or commercial fishing boat having a split trash compacting assembly and fluid actuating assembly disposed in separate locations so that the trash compacting assembly may have a large capacity in a small space.

Still another object of the present invention is to provide a split trash compacting system wherein AC electrical power is not required and only a low voltage control switch is necessary for operating the compactor to avoid the dangers of high voltage sparks and the like.

SUMMARY OF THE INVENTION

The above objectives are accomplished according to the present invention by providing a split-trash compactor system for a vessel comprising a trash compacting assembly disposed in a first area of the vessel readily accessible to persons for receiving and compacting trash. The trash compacting assembly includes a trash bin for receiving trash, and a reciprocating compacting head carried above the trash bin for compacting trash in the bin. At least one fluid actuator unit is provided for forcing the compacting head downward into the trash bin for compacting trash during a compaction cycle and retracting the compacting head to a position above the trash bin during a retraction cycle. A fluid actuating assembly disposed in a second area of the vessel remote from the first area supplies pressurized fluid to the trash compacting assembly to actuate the fluid actuator unit; and at least one fluid line connecting the fluid actuator in the first area and the fluid actuating assembly in the remote second area. A fluid control circuit is provided for controlling flow in the fluid line to reciprocate the compacting head during the compaction cycle and retraction cycle.

Preferably, the compacting assembly is located in a first compartment that includes an interior cabin area or an exterior deck area of the vessel; and the actuating assembly is located in a second compartment remote and generally isolated for noise protection. The fluid control circuit may include an electrical control unit located at the fluid actuating system for controlling a cycle control valve and delivery/return valves connected in the fluid control circuit. Advantageously, a low voltage control switch is disposed at the first location and is operatively connected with the fluid control circuit for controlling the operation of the trash compacting assembly in the first compartment. A low voltage control line connects the switch at the first compartment to the fluid actuating assembly at the second compartment. A pressure switch is operatively connected with the fluid control circuit for switching the fluid actuating assembly from the compaction cycle to the retraction cycle upon sensing a preset pressure level in the fluid line. A timer switch is operatively connected with the fluid control circuit for controlling the operation of the fluid pump wherein the timer switch reverses the operation of the trash compacting assembly from a compaction cycle to a retraction cycle after a predetermined period of time.

In another aspect of the invention, a method of disposing of trash onboard a mobile transport vehicle comprises providing a trash compacting assembly at a first location readily accessible to persons on the vehicle for receiving and compacting trash wherein the trash compacting assembly includes a trash bin for receiving trash, and a reciprocating compacting head having a fluid actuator for compacting trash in the trash bin.

Next, a fluid actuating assembly is disposed in a second, generally isolated location remote from the trash compacting assembly for supplying pressurized fluid to the fluid actuator unit. The method comprises connecting the fluid actuator in the first location and the fluid actuating assembly in the second location with at least one fluid line; and causing a fluid flow in the fluid line to reciprocate the compacting head in compaction and retraction cycles for compacting trash on board the vessel.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
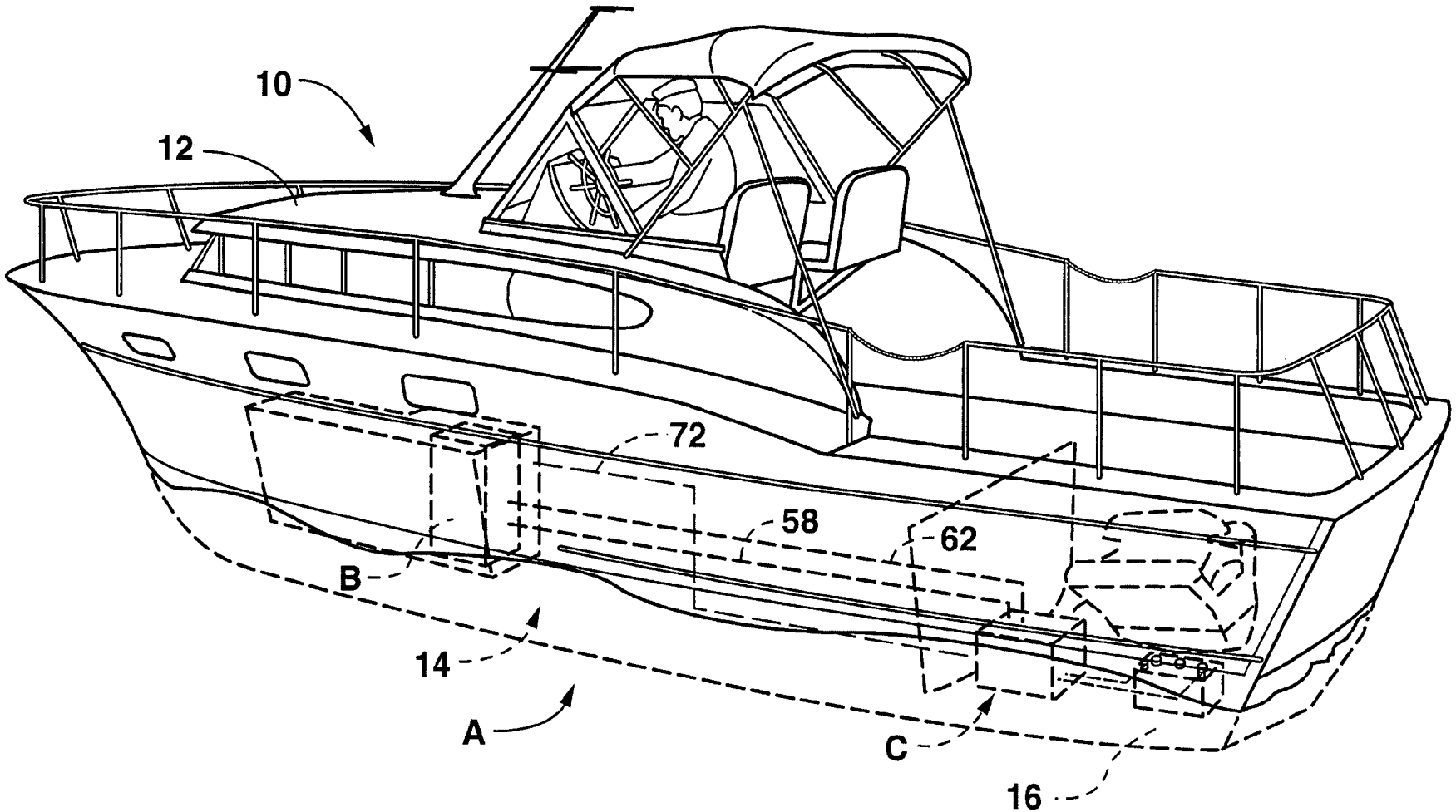
FIG. 1 is a perspective view of a vessel having a split trash compactor system according to the invention.

As can best be seen in FIG. 1, a vessel or boat, designated generally as 10 is illustrated, having a cabin 12 with a galley 14. A split trash compactor system, designated generally as A, is illustrated which includes a trash compacting assembly, designated generally as B, disposed at a location in a first area on the vessel or boat, and a fluid actuating assembly C disposed in a separate compartment at a location in a second area of the vessel remote from the first area and the compacting subassembly. For example, in a vessel having multiple compartments, the trash compacting assembly may be located in cabin area 12 in an easily accessible area such as galley 14 or a deck area, and the fluid actuating assembly may be located an engine compartment 16 or other generally isolated area for sound protection and the like.

Figure 2:
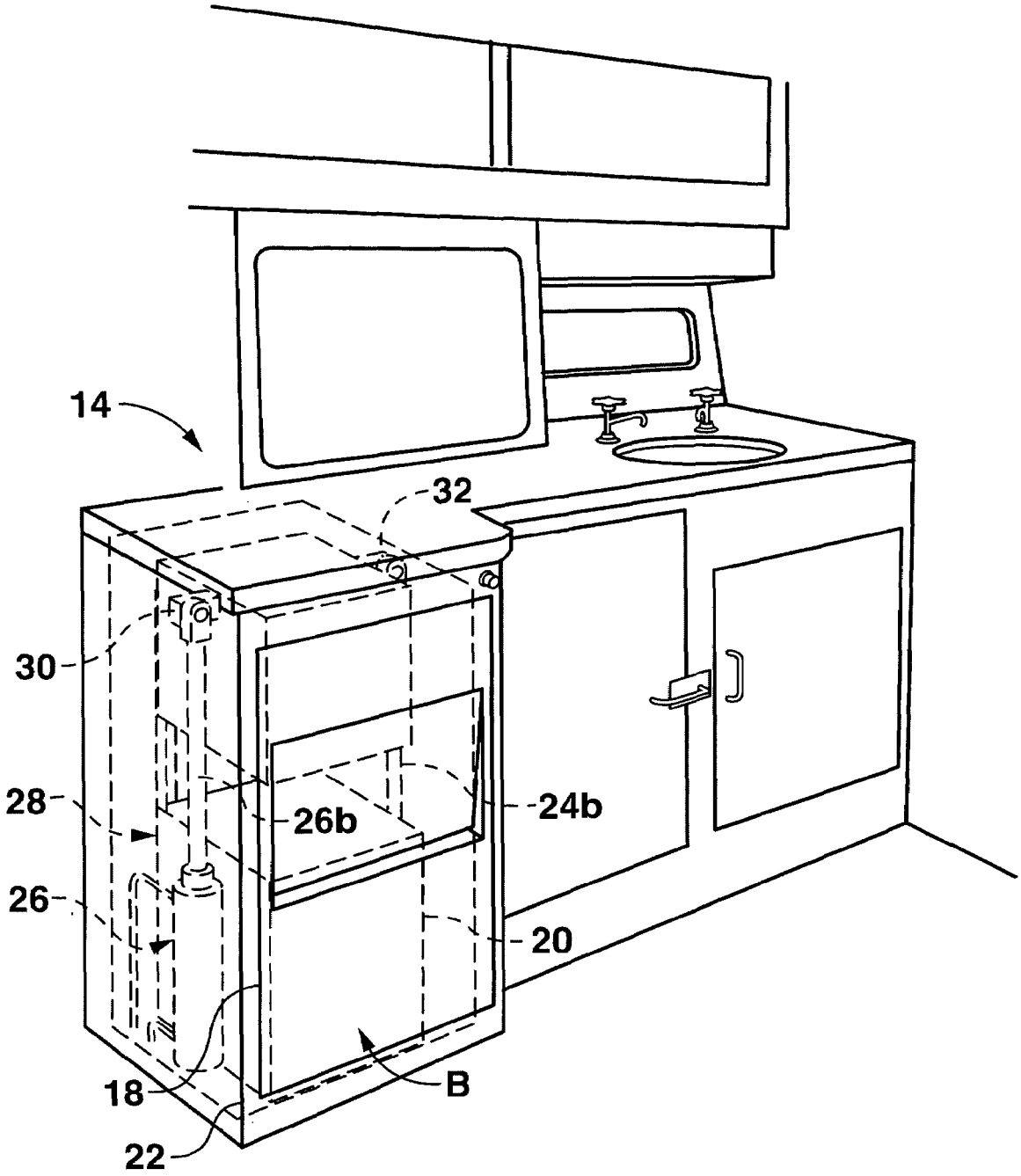
FIG. 2 is a perspective of the compactor assembly of the compactor system which is disposed, for example, in the galley of the vessel; and, FIG. 3 is a hydraulic circuit diagram of a split trash compactor system according to the invention.

As can best be seen in FIGS. 1 and 2, trash compacting assembly B, located generally in the area of gallery 14, includes a drawer 18 having a trash bin 20 for receiving trash. Drawer 18 may be provided with a track that allows the drawer to slide in and out of a cabinet housing 22. When the drawer is pushed in, trash bin 20 is aligned with a compacting head 25 carried within cabinet housing 22 and receivable in trash bin 20 for compacting trash therein. At least one fluid actuator unit is provided for moving the compacting head to compact trash. Preferably, a pair of fluid actuator units 24, 26 are carried within cabinet housing on opposing sides of trash bin 20 by a frame 28 of the trash compacting assembly. As the details of such a frame are known to those skilled in the art, the details of the frame are omitted. Fluid actuator unit 24 includes a cylinder 24*a*, a piston rod 24*b*, and a piston head 24*c* carried on its end that reciprocates in the cylinder. In like manner, fluid actuator unit 26 includes a cylinder 26*a*, a piston rod 26*b*, and a piston head 26*c*. Further, cylinder 24*a* includes an inlet port 24*d* and an outlet port 24*e*, and cylinder 26*a* includes an inlet port 26*d* and an outlet port 26*e*. The upper ends of piston rods 26*b* and 24*b* are attached to blocks 30 and 32 affixed to compacting head 25. In this manner, fluid entering the fluid actuator units 24 and 26 moves the compacting head up and down. A trip switch 34 is carried by compacting head 25 which is tripped by engaging an upper edge 36 of trash bin 20 upon reaching a lowermost position of travel during the compaction cycle in the event the bin is relatively empty.

Figure 3:
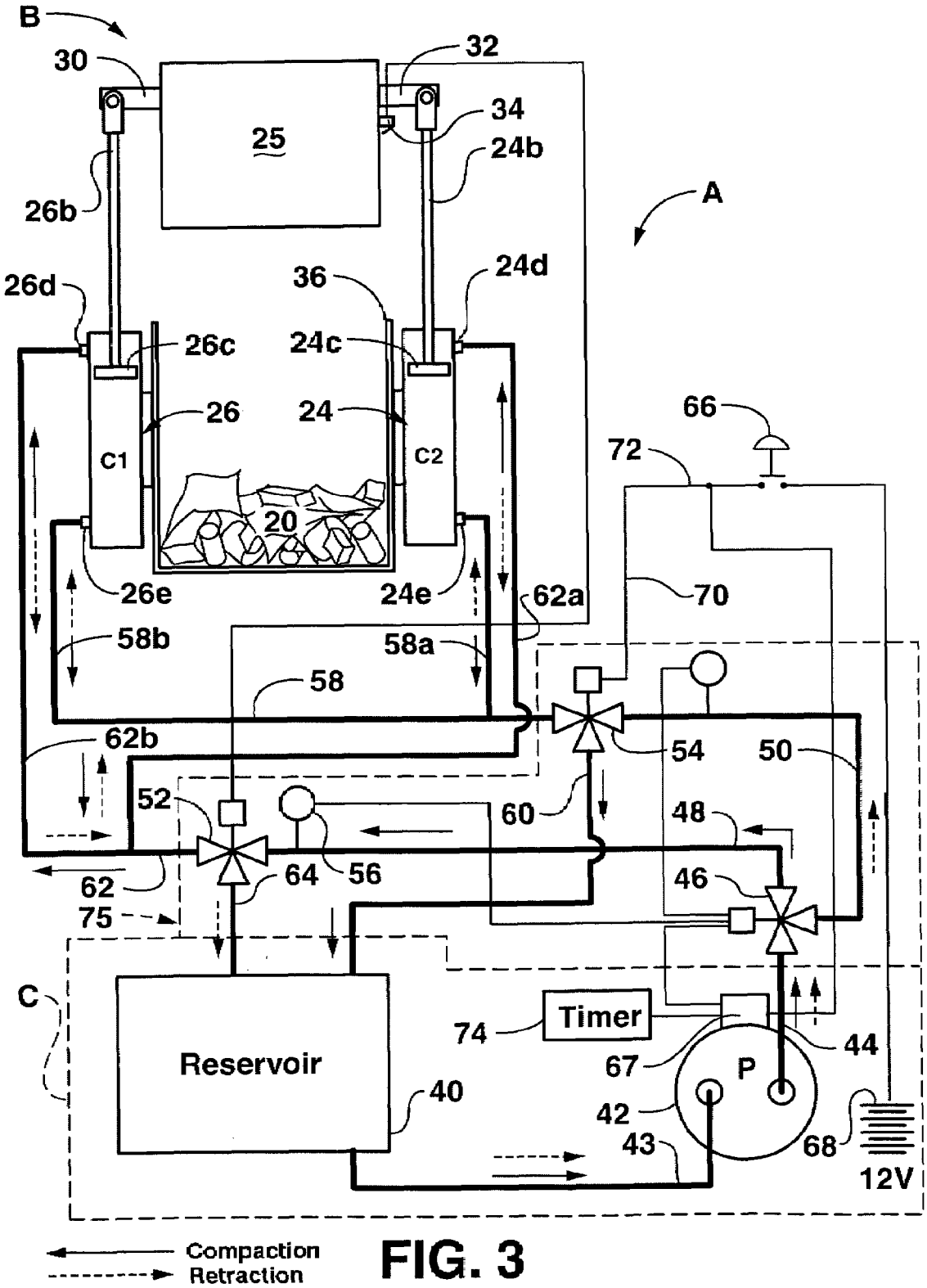

As can best be seen in FIGS. 1 and 3, fluid actuating assembly C, located in a second area remote from gallery 14, includes a fluid reservoir 40 and a fluid pump 42 connected by a supply line 43. In the illustrated example, the fluid system may be hydraulic fluid, but it is to be understood that the system may also be a gas, such as compressed air, rather than a liquid actuating system. A fluid control circuit, located in the second remote area, includes a discharge line 44 connected to a three-way, cycle control valve 46. A first discharge line 48 is connected to one outlet of valve 46 and a second discharge line 50 is connected to a second outlet of valve 46. Discharge line 48 is connected to a second three-way, delivery/return valve 52 and main line 50 is connected to a third three-way, delivery/return valve 54. The three-way valves are normally open. Three-way valves 46, 52, and 54 may be any suitable electro-mechanical flow control device such as conventional solenoid, servo, or motor driven valves.

A pressure switch 56 is connected to a discharge line 48. A first delivery line 58 is connected to a first outlet of valve 54 and a return line 60 is connected to a second outlet of valve 54 terminating in reservoir 40. Delivery line 58 includes a branch line 58*a* connected to retraction port 24*e* of fluid actuator unit 24 and a second branch line 58*b* connected to retraction port 26*e* of fluid actuator unit 26. A second delivery line 62 is connected to a first outlet of valve 52 and a return line 64 is connected to a second outlet of valve 52 terminating at reservoir 40. Delivery line 62 includes a pair of branches 62*a* and 62*b*. Branch line 62*a* is connected to compaction port 24*d* of fluid actuator unit 24. Branch line 62*b* is connected to compaction port 26*d* of fluid actuator unit 26. A low voltage switch 66 is connected to valve 54 for actuating the valve, and loss voltage power source 68.

An electrical control unit 75 is provided by the electrical actuators of electromechanical control valves 46, 52, 54; low voltage control switch 66; pressure switches 56, 61; timer switch 74; and trip switch 34 for controlling fluid flow.

In operation, when switch 66 is depressed, a low power electrical signal 70 (e.g. 12 volts) is sent to valve 54, and to a motor 67 of fluid pump 42. The low power signal actuates valve 54 to close delivery line 58 and switches the pump to establish line voltage (e.g. 115 A/C) to the pump. Pressurized fluid is delivered from the pump along discharge line 48 through valve 52, through branch lines 62*a* and 62*b* to the compaction ports of cylinders 24 and 26. This pressurized fluid forces the piston heads 24*c*, 26*c* down causing compacting head 25 to compact the trash in bin 20. The pressure switch signal actuates valve 54 to block discharge line 50 and place delivery line 58 in communication with return line 60. Displaced fluid flows back through branch lines 58*a* and 58*b* to valve 54, returning to reservoir 40 through return line 60. If there is little trash in bin 20, trip switch 34 may engage the upper edge 36 of the bin on the compacting stroke. When switch 34 is tripped, a low voltage signal is sent to valve 52 thereby actuating the valve and connecting delivery line 62 to the reservoir line 64 via valve 52 relieving the compaction cycle. A timer 70 will reverse the cycles by actuating valve 46 to deliver pressurized fluid through delivery line 50 and valve 54 to retraction ports 24*e*, 26*e* via branch lines 58*a*, 58*b*. This causes the compaction head to retract. At the same time, compaction fluid is returned through compaction ports 24*d*, 26*d* via line branches 62*a*, 62*b* to reservoir 40 through valve 52.

When there is sufficient trash in bin 20 to build up higher pressure in delivery line 48 during a compaction cycle, this pressure will be read by a pressure switch 56 which is preset to actuate valve 46 and reverse the cycles upon reaching a pre-determined pressure. The pressure switch sends a signal to reverse valve 46 to begin a retraction cycle. At the same time, pressure switch signals an actuation of valve 52 to place delivery line 62 in communication with return line 64 and reservoir 40. The subsequent retraction of the compacting head and the return of fluid 64 occurs as described above in reference to trip switch 34. Pressure switch 56 will also switch the pump off when the compacting head is retracted.

Timer 74 reverses the cycle and switches valves 46 and 52 to retract compacting head 25 in the event pressure switch 56 fails to reverse the pump and start the retraction cycle.

While a preferred embodiment of the invention has been described using specific terms, such description is for illustrative purposes only, and it is to be understood that changes and variations may be made without departing from the spirit or scope of the following claims.

What is claimed is:

1. A boat having a split trash compacting system:

said boat having a first compartment including a cabin area having a cabinet housing and a second compartment spaced from and remote said first compartment, said first compartment is located toward the front of the boat, and said second compartment is an engine compartment, which is located toward the back of the boat;

a trash compacting assembly disposed in said cabin area of said first compartment in position within said cabinet housing to be readily accessible to persons in the cabin area for receiving and compacting trash;

the trash compacting assembly including a trash bin for receiving trash, and a reciprocating compacting head carried within said cabinet above the trash bin for compacting trash in the trash bin;

a sliding drawer supporting said trash bin for sliding movement between beneath said compacting head and outside said cabinet housing;

at least one fluid actuator unit for forcing the compacting head downward into the trash bin for compacting trash during a compaction cycle and for retracting the compacting head during a retraction cycle;

a fluid actuating assembly disposed in said second compartment spaced from and remote said first compartment and the trash compacting assembly in said cabin area for supplying pressurized fluid to the trash compacting assembly for actuating the fluid actuator unit;

at least one fluid line routed through the first and second compartments for connecting the fluid actuator in the cabin area and the fluid actuating assembly in said second compartment; and a fluid control circuit for controlling flow in the fluid line to reciprocate the compacting head during the compaction cycle and retraction cycle, said fluid control circuit includes a plurality of control valves and switches, and control wiring located with said fluid actuating assembly in said second compartment;

whereby a minimum of space within said first compartment and the cabin area is utilized by said compacting system.

2. The system of claim 1 wherein said at least one fluid actuator unit includes a first fluid actuator unit and a second fluid actuator unit, the fluid actuator units being connected to the compacting head for actuating the compacting head in the compaction and retraction cycles.

3. The system of claim 1 wherein said fluid actuating assembly includes a fluid pump connected to a source of motive fluid.

4. The system of claim 1 including a low voltage control switch disposed at the first compartment and operatively connected with the fluid control circuit for controlling the operation of the trash compacting assembly in the second compartment.

5. The system of claim 4 including a low voltage control line connecting the switch at the first compartment to the fluid actuating assembly at the second compartment.

6. The system of claim 1 including a pressure switch operatively connected with the fluid control circuit for switching the fluid actuating assembly from the compaction cycle to the retraction cycle upon sensing a preset pressure level in the fluid line.

7. The system of claim 3 including a timer switch operatively connected with the fluid control circuit for controlling the operation of the fluid pump wherein the timer switch reverses the operation of the trash compacting assembly from a compaction cycle to a retraction cycle after a predetermined period of time.

8. A split-trash compacting system for a boat comprising:

a first compartment including a cabin area, the first compartment is located in a vicinity of the front of the boat;

a trash compacting assembly located in said cabin area in position to be readily accessible to persons for receiving and compacting trash;

said trash compacting assembly including a trash bin for receiving trash, a reciprocating compacting head carried above said trash bin for compacting trash in the trash bin within a cabinet located in said cabin area, and a sliding drawer supporting said trash bin, said sliding drawer slides relatives to the trash compacting head and the cabinet, and at least one fluid actuator unit for forcing the compacting head downward into the trash bin for compacting trash during a compaction cycle and retracting the compacting head to a position above the trash bin during a retraction cycle;

a fluid actuating assembly disposed in a second compartment located in a second area toward the back of the boat remote and generally isolated from said first compartment and said cabin area for supplying pressurized fluid to the trash compacting assembly to actuate the fluid actuator unit, said second compartment is an engine compartment;

at least one fluid line connecting the fluid actuator unit in the said cabin area and the fluid actuating assembly in the second compartment in the remote second area; and a fluid control circuit located within the second compartment for controlling flow in the fluid line to reciprocate the compacting head during the compaction cycle and retraction cycle, said fluid control circuit includes a plurality of control valves and switches, and control wiring located with said fluid actuating assembly in said second compartment;

whereby the operation of said fluid actuating assembly is effectively isolated from said first cabin area.

9. The system of claim 8 wherein the fluid actuating assembly includes a low voltage control switch disposed in said first compartment and operatively connected with a fluid pump located in said second compartment for controlling the operation of the pump, and a low voltage control line connecting the control switch with the fluid pump at the second compartment.

10. The system of claim 8 wherein said fluid actuating assembly includes a fluid pump connected to a source of motive fluid, said fluid actuating assembly including a pressure switch operatively connected with the fluid line for reversing the fluid pump from the compaction cycle to the retraction cycle upon sensing a preset pressure level in the fluid line.

11. A method of disposing of trash onboard a boat comprising:

providing a trash compacting assembly within a first compartment including a galley area said compacting assembly being readily accessible to persons on the boat for receiving and compacting trash, said first compartment is located toward the front of the boat;

providing the trash compacting assembly including a trash bin for receiving trash, a reciprocating compacting head having a fluid actuator for compacting trash in the trash bin, and a sliding drawer supporting said trash bin, said sliding drawer slides relatives to the reciprocating compacting head;

providing a fluid actuating assembly including a fluid control circuit disposed in a second compartment located in a generally isolated and remote location spaced from the galley area of said first compartment for actuating the trash compacting assembly with pressurized fluid from the fluid actuator unit, said second compartment is an engine compartment located toward the back of the boat, said fluid control circuit includes a plurality of control valves and switches, and control wiring located with said fluid actuating assembly in said second compartment;

connecting the fluid actuator in said first compartment and the fluid actuating assembly in the second compartment with at least one fluid line; and controlling a fluid flow in the fluid line between the first and second compartments to reciprocate the compacting head between a compaction cycle and a retraction cycle for receiving and compacting trash while protecting the first compartment from noise.

12. The method of claim 11 including providing a low voltage switch and connecting the low voltage switch at the first compartment to the fluid actuating assembly and at the second compartment with a low voltage control line.

13. The method of claim 11 including providing a pressure switch and operatively connecting the pressure switch with the fluid control circuit for switching the fluid actuating assembly from the compaction cycle to the retraction cycle upon sensing a preset pressure level in the fluid line.

14. The method of claim 11 including providing a timer switch and operatively connecting the timer switch with the fluid control circuit for controlling the operation of a fluid pump wherein the timer switch switches the operation of the trash compacting assembly from a compaction cycle to a retraction cycle after a predetermined period of time.

* * * * *